United States Patent [19]

Kalnin et al.

[11] 4,364,916

[45] Dec. 21, 1982

[54] PROCESS FOR THE PRODUCTION OF STABILIZED ACRYLIC FIBERS WHICH ARE PARTICULARLY SUITED FOR THERMAL CONVERSION TO CARBON FIBERS

[75] Inventors: Ilmar L. Kalnin, Millington; George J. Breckenridge, Jr., Clark; Andrew H. DiEdwardo, Parsippany; John M. Rhodes, Summit, all of N.J.

[73] Assignee: Celanese Corporation, New York, N.Y.

[21] Appl. No.: 311,131

[22] Filed: Oct. 14, 1981

[51] Int. Cl.[3] ..... D01F 9/22

[52] U.S. Cl. ..... 423/447.6; 8/115.5; 264/29.2; 423/447.4; 423/447.5

[58] Field of Search ..... 423/447.4, 447.5, 447.6; 8/115.5; 264/29.2

*Primary Examiner*—Edward J. Meros

*Attorney, Agent, or Firm*—Burns, Doane, Swecker & Mathis

[57] ABSTRACT

An improved process for the relatively rapid thermal stabilization of a multifilamentary acrylic fibrous material in the substantial absence of filament coalescence is provided. The fibrous material is initially contacted with a solution of hydroxylamine (as described), and subsequently with a solution of ammonium permanganate, calcium permanganate, magnesium permanganate, or mixtures thereof (as described). The resulting fibrous material which possesses a chemically altered structure is heated in an oxygen-containing atmosphere until a thermally stabilized acrylic fibrous material is formed which is capable of undergoing carbonization and is non-burning when subjected to an ordinary match flame.

22 Claims, No Drawings

PROCESS FOR THE PRODUCTION OF STABILIZED ACRYLIC FIBERS WHICH ARE PARTICULARLY SUITED FOR THERMAL CONVERSION TO CARBON FIBERS

BACKGROUND OF THE INVENTION

In the past procedures have been proposed for the conversion of fibers formed from acrylic polymers to a modified form possessing enhanced thermal stability. Such modification has generally been accomplished by heating the fibrous material in an oxygen-containing atmosphere at a moderate temperature for an extended period of time.

U.S. Pat. Nos. 2,913,802 to Barnett and 3,285,696 to Tsunoda disclose processes for the conversion of fibers of acrylonitrile homopolymers or copolymers to a heat resistant form. The stabilization of fibers of acrylonitrile homopolymers and copolymers in an oxygen-containing atmosphere commonly involves (1) a chain scission and oxidative cross-linking reaction of adjoining molecules as well as (2) a cyclization reaction of pendant nitrile groups. It is generally recognized that the rate at which the stabilization reaction takes place increases with the temperature of the oxygen-containing atmosphere. However, in the past the stabilization reaction must by necessity at least initially be conducted at relatively low temperatures (i.e. well below 300° C.), since the cyclization reaction is known to be exothermic in nature and must be controlled if the original configuration of the material undergoing stabilization is to be preserved in the absence of undesirable fiber coalescence which impairs the tenacity values of the final product. Accordingly, the stabilization reaction has tended to be time consuming, and economically demanding because of low productivity necessitated by the excessive time requirements. Representative processes proposed to shorten the time period required for the stabilization reaction include: U.S. Pat. Nos. 3,416,874; 3,539,295; 3,592,595; 3,647,770; 3,650,668; 3,656,882; 3,656,883; 3,708,326; 3,720,759; 3,729,549; 3,813,219; 3,814,577; 3,817,700; 3,820,951; 3,850,876; 3,923,950; 4,002,426; 4,004,053, and British Pat. Nos. 1,253,827; 1,260,449; 1,264,763; 1,375,136; and 1,448,468.

In U.S. Pat. Nos. 3,767,773 and 3,900,285; British Pat. No. 1,280,850; Belgian Pat. No. 743,458; Netherlands Pat. No. 6,919,555; German Pat. Nos. 2,054,255 and 2,358,853; U.S.S.R. Pat. No. 389,012; and *Melliand Textilberichte,* Vol. 38, Pages 65–68 by F. Schoutenden (1957) is disclosed the treatment of acrylic fibers with hydroxylamine. In U.S. Pat. No. 3,497,318; British Pat. No. 1,213,387; and the *Indian Journal of Technology,* Vol. 13, Pages 277–280 by Iqbal Singh (June, 1975) is disclosed the treatment of acrylic fibers with inter alia potassium permanganate.

Prior art processes which have attempted to shorten the time required for the thermal stabilization of acrylic fibers to render them suitable for carbon fiber formation commonly have resulted in at least some level of undesirable coalescence of adjoining fibers particularly if the multifilamentary material is contacted with heated rolls during the stabilization reaction. Points of coalescence in the fibers have been found to lead to diminished tenacity values in the desired fibrous carbonaceous product.

It is an object of the present invention to provide an improved process for the thermal stabilization of acrylic fibers.

It is an object of the present invention to provide an overall improved process for the thermal stabilization of acrylic fibers which can advantageously be carried out in a relatively brief period of time in the substantial absence of undesirable fiber coalescence.

It is another object of the present invention to provide an improved process for the thermal stabilization of acrylic fibers which readily can be carried out on a continuous basis.

It is a further object of the present invention to provide an improved process for the thermal stabilization of acrylic fibers wherein the fibers are capable of being heated in a gaseous oxygen-containing atmosphere while undergoing thermal stabilization which is at a more highly elevated temperature than would otherwise be possible thereby expediting the desired stabilization.

These and other objects, as well as the scope, nature, and utilization of the specifically claimed overall process will be apparent to those skilled in the art from the following description and appended claims.

SUMMARY OF THE INVENTION

It has been found that an improved process for the relatively rapid thermal stabilization of a multifilamentary acrylic fibrous material in the substantial absence of filament coalescence comprises:

(a) contacting the acrylic fibrous material with a dilute solution of hydroxylamine having a pH of approximately 6 to 8 provided at a temperature of approximately 95° to 130° C., (b) washing the fibrous material, (c) contacting the resulting fibrous material with a dilute solution of an oxidizing agent selected from the group consisting of ammonium permanganate, calcium permanganate, magnesium permanganate, and mixtures thereof, provided at a temperature of approximately 80° to 120° C., (d) washing the fibrous material, and (e) heating the resulting fibrous material in a gaseous oxygen-containing atmosphere until a thermally stabilized acrylic fibrous material is formed which is capable of undergoing carbonization and is non-burning when subjected to an ordinary match flame.

DESCRIPTION OF PREFERRED EMBODIMENTS

The multifilamentary acrylic fibrous material undergoing stabilization in the present process may be formed by conventional solution spinning techniques (i.e. it may be dry spun or wet spun), and is commonly drawn to increase its orientation. As is known in the art, dry spinning is commonly conducted by dissolving the polymer in an appropriate solvent, such as N,N-dimethylformamide or N,N-dimethylacetamide, and passing the solution through an opening of predetermined shape into an evaporative atmosphere (e.g. nitrogen) in which much of the solvent is evaporated. Wet spinning is commonly conducted by passing a solution of the polymer through an opening of predetermined shape into a coagulation bath.

The acrylic polymer utilized as the starting material is formed primarily of recurring acrylonitrile units. For instance, the acrylic polymer should be either an acrylonitrile homopolymer or an acrylonitrile copolymer which contains not less than about 85 mole percent of acrylonitrile units (e.g. at least 95 mole percent) and not more than about 15 mole percent of units (e.g. up to about 5 mole percent) derived from a monovinyl compound which is copolymerizable with acrylonitrile such as styrene, methyl acrylate, methyl methacrylate, vinyl acetate, vinyl chloride, vinylidene chloride, vinyl pyridine, and the like, or a plurality of such monomers. The pendant nitrile groups present within the acrylic multifilamentary fibrous material prior to thermal stabilization are substantially uncyclized.

The acrylic multifilamentary precursor is preferably provided as a continuous length of fibrous material and may be in a variety of physical configurations. For instance, the acrylic fibrous materials may be present in the form of continuous lengths of multifilament yarns, tows, tapes, strands, cables, or similar fibrous assemblages.

When the starting material is a continuous multifilament yarn, a twist may be imparted to the same to improve the handling characteristics. For instance, a twist of about 0.1 to 5 tpi, and preferably about 0.3 to 1.0 tpi may be utilized. Also a false twist may be used instead of or in addition to a real twist. Alternatively, one may select bundles of fibrous material which possess substantially no twist.

The starting material may be drawn in accordance with conventional techniques in order to improve its orientation. For instance, the starting material may be drawn by stretching while in contact with a hot shoe at a temperature of about 140° to 160° C. Additional representative drawing techniques are disclosed in U.S. Pat. Nos. 2,455,173; 2,948,581; and 3,122,412. It is recommended that the acrylic fibrous materials selected for use in the process be drawn to a single filament tenacity of at least about 3 grams per denier. If desired, however, the starting material may be more highly oriented, e.g. drawn up to a single filament tenacity of about 7.5 to 8 grams per denier, or more. However, as pointed out hereafter the fibrous material particularly following wet spinning alternatively may be structurally modified as described hereafter prior to a drawing.

In accordance with the process of the present invention the acrylic multifilamentary fibrous material is chemically altered through the use of two specifically defined structural modification steps which are carried out sequentially prior to the heating of the same in an oxygen-containing atmosphere. It has been found that such process steps in combination offer significant process advantages which facilitate a relatively rapid acrylic thermal stabilization when ultimately heated in an oxygen-containing atmosphere while concomitantly effectively avoiding coalescence of adjoining fibers.

Initially the acrylic fibrous material is contacted with a dilute solution of hydroxylamine having a pH of approximately 6 to 8 provided at a temperature of approximately 95° to 130° C. During such contact a portion (e.g. 10 to 15 percent) of the pendant nitrile groups of the acrylic fibrous material react to form amidoxime groups. Such reaction can be confirmed by conventional infrared analysis techniques whereby a decrease in nitrile absorption at 2250 $cm^{-1}$, accompanied by a corresponding growth of absorption peaks at 930, 1220, 1340, 1380, 1595, 1655, 2860, 3200, 3350 and 3440 $cm^{-1}$, consistent with amidoxime and/or hydroxamic structures, is observed. Water is the preferred solvent for the hydroxylamine when contacted with the acrylic fibrous material; however, other solvents can also be present in the water which do not deleteriously influence the fibrous material. Representative of such mixed solvents which can be utilized are water/N,N-dimethylformamide, water/N,N-dimethylacetamide, water/N,N-methyl-2-pyrrolidone, etc.

The hydroxylamine solution preferably is formed by the dissolution of hydroxylamine acid addition salts in water to generate the desired hydroxylamine following addition of an appropriate base. Suitable acid addition salts include: hydroxylamine sulfate, hydroxylamine hydrochloride, hydroxylamine nitrate, hydroxylamine bisulfate, etc. The particularly preferred acid addition salts from a cost standpoint are the hydrochloride, sulfate and nitrate. The pH of the solution is adjusted to approximately 6 to 8, preferably approximately 6.5 to 7.5 (e.g. approximately 7) by the addition to the solution of a base (e.g. sodium carbonate, barium hydroxide, sodium hydroxide, etc.). The hydroxylamine commonly is provided in the solution in a concentration of approximately 1 to 6 percent by weight, and preferably is provided in the solution in a concentration of approximately 4 to 6 percent by weight (e.g. approximately 5 percent by weight). When the hydroxylamine concentration is much lower than about 4 percent by weight then the desired reaction tends to be inordinantly slow. When the hydroxylamine concentration is much higher than about 6 percent by weight then damage to the acrylic fibers may result.

As indicated the hydroxylamine solution is provided at a temperature of approximately 95° to 130° C. when contacted with the acrylic fibrous material, and most preferably at a temperature of approximately 95° to 100° C. If the temperature of the solution is much below 95° C., then the desired chemical modification tends to be inordinately time consuming. If the temperature of the solution is much above 130° C., then the hydroxylamine tends to decompose and does not accomplish the desired chemical modification of the acrylic fibrous material.

Contact times between the acrylic fibrous material and the hydroxylamine solution can be relatively brief. For instance, such contact times can be approximately 2 to 6 minutes (e.g. 2 to 4 minutes) in duration. During such contact the multifilamentary acrylic fibrous material preferably is maintained at a relatively constant length. The required contact between the acrylic fibrous material and the hydroxylamine solution can be accomplished by a variety of techniques, e.g. immersion, spraying, padding, etc. For instance, in a preferred embodiment a continuous length of the fibrous material can be passed in the direction of its length through a bath containing the hydroxylamine solution which is continuously or intermittently replenished.

Following contact with the hydroxylamine solution the resulting chemically modified acrylic fibrous material is washed in order to remove adhering hydroxylamine since the presence of such compound would result in the unnecessary and wasteful consumption of the oxidizing agent employed in the subsequent chemical modification step of the present process. Such wash step can conveniently be carried out by rinsing the fibrous material with water, e.g. by continuous passage through one or more wash baths immediately following the required contact with the hydroxylamine solution. An ultrasonic unit may be used to assist in the washing of the fibrous material.

The acrylic fibrous material next is contacted with a dilute solution of selected oxidizing agents, i.e. ammonium permanganate, calcium permanganate, magnesium permanganate, or mixtures thereof which is provided at a temperature of approximately 80° to 120° C., and most preferably at a temperature of approximately 95° to 100° C. Such contact beneficially results in the requisite degree of oxidation or cross-linking of the surfaces of the acrylic fibers to substantially minimize coalescence of adjoining fibers when the fibers previously modified by the hydroxylamine treatment are subsequently heated in an oxygen-containing atmosphere. It has been found that the selection of the named oxidizing agents is of prime importance. More specifically, if oxidizing agents such as sodium permanganate or potassium permanganate are employed, they have been found to be unduly reactive and to deleteriously degrade the fibrous material. Also, the sodium or potassium ions may be difficult to remove and serve to catalyze undesirable defect forming side reactions during subsequent processing wherein carbon fibers ultimately are formed.

The named oxidizing agent preferably is provided in the solution in a concentration approximately 0.5 to 2 percent by weight (e.g. approximately 1.5 percent by weight). The preferred solvent for use in forming the solution is water and the preferred temperature for the solution at the time of contact with the fibrous material is approximately 95° to 100° C. Contact times between the fibrous material and the oxidizing solution can be relatively brief. For instance, contact times of approximately 1 to 4 minutes (e.g. approximately 2 minutes) can be conveniently employed. During such contact the multifilamentary material preferably is maintained at a relatively constant length. The required contact between the fibrous material and the oxidizing solution can be accomplished by a variety of techniques, e.g. immersion, spraying, padding, etc. For instance, in a preferred embodiment a continuous length of the fibrous material can be passed in the direction of its length through a bath containing the oxidizing solution which is continuously or intermittently replenished.

In a particularly preferred embodiment of the process the oxidizing agent employed is ammonium permanganate. Residues of such compound can be readily removed through the volatilization of ammonia gas at the conclusion of the reaction with the fibrous material. Additionally, the relatively dilute ammonium permanganate solutions employed have been found to possess adequate stability under the reaction conditions employed with only limited decomposition being observed. The required ammonium permanganate readily can be prepared by the reaction of potassium permanganate and ammonium fluorosilicate in accordance with the following equation:

$$2KMnO_4+(NH_4)_2SiF_6 \rightarrow K_2SiF_6+2NH_4MnO_4$$

This reaction can be carried out in an aqueous solution, the potassium fluorosilicate by-product removed as a solid precipitate, and the required ammonium permanganate solution provided. The calcium permanganate, and the magnesium permanganate oxidizing agents can be prepared by standard techniques.

When the named oxidizing agents react with the fibrous material, a particulate $MnO_2$ by-product results. Following the treatment with the oxidizing agent this fine powdery by-product as well as calcium and magnesium ions (if any) are substantially removed by the washing of the resulting fibrous material. Such wash step can conveniently be carried out by rinsing the fibrous material with water or with a dilute acid followed by a water rinse. This can readily be done by continuous passage through one or more wash baths immediately following the contact with the oxidizing solution. Such washing is preferably carried out at least in part in an ultrasonic bath. Any ammonia by-product present is expeditiously volatilized in a final drying treatment.

In an embodiment of the present process the acrylic fibrous material can be subjected to the hydroxylamine and oxidizing treatments (previously described) prior to the conventional fiber drawing step which is designed to improve its tensile properties. For instance, a wet spun acrylic fibrous material immediately after coagulation while still in a swollen state can be subjected to such treatments and subsequently drawn. The swollen nature of the fibers allows more ready access for the hydroxylamine reactant. A minor concentration (e.g. 5 percent by weight based upon the weight of the polymer) of a swelling agent such as lithium chloride optionally can be included in the fiber spinning solution so as to further augment the swelling. All steps of such process could be carried out on a continuous length of acrylic fibrous material on a continuous in-line manner.

The chemically modified acrylic fibrous material is expeditiously thermally stabilized by heating in an oxygen-containing gaseous atmosphere to form a thermally stabilized acrylic fibrous material which is substantially free of filament coalescence, capable of undergoing carbonization, and non-burning when subjected to an ordinary match flame. In a preferred embodiment of the process the oxygen-containing atmosphere is air. Preferred temperatures of the oxygen-containing atmosphere range from about 240° to 310° C. Such temperatures can be sequentially raised during the course of the thermal stabilization reaction with the fibrous material being subjected to an increasing temperature gradient. An acrylonitrile homopolymer or a closely related copolymer can initially be subjected to a higher temperature than an acrylonitrile copolymer which contains a substantial proportion of copolymerized monovinyl units other than acrylonitrile.

For best results, uniform contact during the stabilization reaction with molecular oxygen throughout all portions of the previously modified acrylic material is encouraged. Such uniform reaction conditions can best be accomplished by limiting the mass of fibrous material at any one location so that heat dissipation from within the interior of the same is not unduly impaired, and free access to molecular oxygen is provided. For instance, the acrylic fibrous material or film may be placed in the oxygen-containing atmosphere while wound upon a support to a limited thickness. In a preferred embodiment of the invention, the impregnated acrylic fibrous material is continuously passed in the direction of its length through the heated oxygen-containing atmosphere. For instance, a continuous length of the acrylic fibrous material may be passed through a circulating oven or the tube of a muffle furnace. The speed of passage through the heated oxygen-containing atmosphere will be determined by the size of the heating zone and the desired residence time.

The period of time required to accomplish the thermal stabilization can be relatively rapid since the initial hydroxylamine treatment serves to render the exothermic character of the cyclization reaction which occurs during the stabilization reaction less severe. Additionally, one can proceed to higher stabilization temperatures more quickly where the desired stabilization reaction proceeds at a more rapid rate in the substantial absence of filament coalescence as a result of the treatment with an oxidizing agent (previously described). Commonly, the stabilization reaction is carried out in air employing an acrylic fibrous material of about 0.9 denier per filament in less than one hour, preferably less than 40 minutes, and most preferably under 35 minutes. The specific heating temperatures employed will vary somewhat with the chemical nature and denier per filament of the acrylic polymer initially selected. Optimum heating conditions for a specific acrylic fiber can be developed by those skilled in the art through the use of routine experimentation. It has been found that a satisfactory heating profile in air of an acrylonitrile fibrous material available from Toho Beslon Co. under the designation of Beslon is 270° C. for 29 minutes, and 307° C. for 4.6 minutes. A suitable heating temperature in air of an acrylonitrile copolymer fibrous material available from the DuPont Co. under the designation Orlon is 260° C. for 45 minutes. Alternatively, a final portion of the stabilization reaction optionally can be carried out in a non-oxidizing atmosphere such as nitrogen.

The multifilamentary stabilized acrylic fibrous materials formed in accordance with the present process are black in appearance, substantially non-coalesced, dimensionally stable, flexible, retain essentially the same configuration as the starting material, are non-burning when subjected to an ordinary match flame, commonly have a bound oxygen content of at least 7 (e.g. 7 to 12) percent by weight as determined by the Unterzaucher or other suitable analysis, and commonly contain from about 50 to 65 percent carbon by weight.

The resulting stabilized acrylic fibrous material may next be heated in a non-oxidizing atmosphere at a temperature of at least 1000° C. to form a carbonaceous fibrous material containing at least 90 percent carbon by weight which retains its original fibrous configuration intact. Such carbon fiber forming treatment may be conducted in accordance with known techniques. The non-oxidizing atmosphere may be nitrogen, argon, helium, etc. A carbonized product including substantial amounts of graphitic carbon results if the temperature is more severe, e.g. about 2000° to about 3000° C. The presence of graphitic carbon may be detected by the characteristic X-ray diffraction pattern of graphite. Representative techniques for forming carbon fibers from the resulting stabilized acrylic fibrous materials are disclosed in U.S. Pat. Nos. 3,656,904; 3,723,605; 3,900,556; and 3,914,393 which are herein incorporated by reference.

The resulting fibers preferably are surface treated in accordance with known techniques prior to incorporation in a matrix material (e.g. an epoxy resin) to form a fiber reinforced composite article. Representative surface treatment processes are disclosed in U.S. Pat. Nos. 3,723,150; 3,723,607; 3,745,104; 3,754,957; 3,762,941; 3,859,187; and 3,894,884 which are herein incorporated by reference.

Carbon fibers are being increasingly utilized as the reinforcing medium in resinous and metallic matrix materials. When synthetic resinous materials are selected for the matrix, lightweight composite articles are formed which particularly are suited for use as aerospace components, sporting goods, etc.

The following examples are given as specific illustrations of the overall process of the claimed invention. It should be understood, however, that the invention is not limited to the specific details set forth in the examples.

EXAMPLE I

A continuous length of a 6000 filament acrylic tow comprising 98 mole percent acrylonitrile units and 2 mole percent methylacrylate units was selected as the starting material. The filaments each possessed a denier of approximately 0.9 and were aligned in a substantially parallel configuration within the tow.

To accomplish the desired thermal stabilization in the substantial absence of coalescence among filaments, the tow was continuously passed at a rate of 0.65 meters/minute through (a) a pair of solutions of hydroxylamine, (b) a washing zone, (c) a solution of ammonium permanganate, (d) another washing zone, and (e) a thermal stabilization zone.

The hydroxylamine solutions contained hydroxylamine in a 5 percent by weight concentration and were prepared by dissolving hydroxylamine hydrochloride in water and adjusting the pH to approximately 7 by the addition of sodium carbonate. Each solution was provided in an elongated vessel at a temperature of approximately 98° C. and the acrylic tow was passed through each for a residence time of 2.9 minutes to produce a total residence time in the hydroxylamine solutions of 5.8 minutes. Submerged rollers were employed to direct the movement of the tow.

Following passage through the hydroxylamine solutions the tow was spray rinsed with water to remove adhering hydroxylamine solution.

The ammonium permanganate solution was prepared by dissolving 1.5 percent by weight ammonium permanganate in water. This solution also was provided at a temperature of approximately 98° C. within an elongated vessel. The tow passed through this solution for a residence time of 2.9 minutes. Submerged rollers were employed to direct the movement of the tow.

Following passage through the ammonium permanganate solution the tow was passed through a water wash bath wherein ultrasonics assisted in the removal of adhering extraneous substances such as the $MnO_2$ byproduct.

The termal stabilization of the chemically modified tow was accomplished by passing the tow for a residence time of 60 minutes through a forced air oven provided at 260° C. Parallel rollers were provided to direct the movement of the tow through the oven. During passage through the oven the tow was allowed to shrink 5 percent in length through the adjustment of the roller speeds at the entrance and exit ends of the oven. The resulting stabilized tow was flexible and free of coalescence among adjoining filaments. It was black in appearance, and non-burning when subjected to an ordinary match flame.

The stabilized tow next was carbonized to form a carbonaceous fibrous material containing at least 90 percent carbon by weight by passage at a speed of 30 inches per minute through a vertical pyrolysis oven provided at a maximum temperature of 1230° C. during which time the tow was allowed to shrink 6 percent in length. Since filaments of carbon fibers were removed from the tow and tested. Based upon an average of five single filament breaks the following highly satisfactory results were observed:

| | |
|---|---|
| Tenacity | 20.5 grams per denier |
| Elongation | 1.18 percent |
| Initial Modulus | 1710 grams per denier |

EXAMPLE II

Example I was repeated with the exception that the process was carried out on a more expeditious basis including a multiple stage stabilization treatment in air.

More specifically, the tow was continuously passed at a rate of 1.35 meters/minute through the various solutions and was treatments prior to heating in air. The tow was passed through each hydroxylamine solution for a residence time of 1.4 minutes to produce a total residence time in such solutions of 2.8 minutes. The tow was passed through the ammonium permanganate solution for a residence time of 1.4 minutes.

The thermal stabilization of the chemically modified tow was accomplished by passing the resulting tow for a residence time of 29 minutes through a forced air oven provided at 270° C., and for a residence time of 4.6 minutes through a forced air oven provided at 307° C. As in Example I, the resulting stabilized tow was flexible and free of coalescence among adjoining filaments. It was black in appearance, non-burning when subjected to an ordinary match flame, and capable of undergoing carbonization to form carbon fibers.

Although the invention has been described with preferred embodiments, it is to be understood that variations and modifications may be resorted to as will be apparent to those skilled in the art. Such variations and modifications are to be considered within the purview and scope of the claims appended hereto.

We claim:

1. An improved process for the relatively rapid thermal stabilization of a multifilamentary acrylic fibrous material in the substantial absence of filament coalescence comprising:
   (a) contacting said acrylic fibrous material with a dilute solution of hydroxylamine having a pH of approximately 6 to 8 provided at a temperature of approximately 95° to 130° C.,
   (b) washing said fibrous material,
   (c) contacting said resulting fibrous material with a dilute solution of an oxidizing agent selected from the group consisting of ammonium permanganate, calcium permanganate, magnesium permanganate, and mixtures thereof, provided at a temperature of approximately 80° to 120° C.,
   (d) washing said fibrous material, and
   (e) heating said resulting fibrous material in a gaseous oxygen-containing atmosphere until a thermally stabilized acrylic fibrous material is formed which is capable of undergoing carbonization and is non-burning when subjected to an ordinary match flame.

2. An improved process according to claim 1 wherein said multifilamentary acrylic fibrous material is selected from the group consisting of an acrylonitrile homopolymer and acrylnitrile copolymers containing at least 85 mole percent acrylonitrile units and up to about 15 mole percent of one or more monovinyl units copolymerized therewith.

3. An improved process according to claim 1 wherein said multifilamentary acrylic fibrous material is in the configuration of a tow.

4. An improved process according to claim 1 wherein said multifilamentary acrylic fibrous material is in the configuration of a yarn.

5. An improved process according to claim 1 wherein hydroxylamine is provided in said dilute solution of step (a) in a concentration of approximately 4 to 6 percent by weight while employing an aqueous solvent, and said oxidizing agent is provided in said dilute solution of step (c) in a concentration of approximately 0.5 to 2 percent by weight while employing an aqueous solvent.

6. An improved process according to claim 1 wherein said oxidizing agent employed in step (c) is ammonium permanganate.

7. An improved process according to claim 1 which includes the additional step (f) of heating the resulting stabilized acrylic fibrous material in a non-oxidizing atmosphere at a temperature of at least 1000° C. to form a carbonaceous fibrous material containing at least 90 percent carbon by weight which retains its original fibrous configuration.

8. An improved process for the relatively rapid thermal stabilization of a multifilamentary acrylic fibrous material in the substantial absence of filament coalescence comprising:
   (a) contacting said acrylic fibrous material with an approximately 4 to 6 percent by weight aqueous solution of hydroxylamine having a pH of approximately 6 to 8 provided at a temperature of approximately 95° to 130° C. for approximately 2 to 6 minutes,
   (b) washing said fibrous material,
   (c) contacting said resulting fibrous material with an approximately 0.5 to 2 percent by weight aqueous solution of an oxidizing agent selected from the group consisting of ammonium permanganate, calcium permanganate, magnesium permanganate, and mixtures thereof, provided at a temperature of approximately 80° to 120° C. for approximately 1 to 4 minutes,
   (d) washing said fibrous material, and
   (e) heating said resulting fibrous material in a gaseous oxygen-containing atmosphere until a thermally stabilized acrylic fibrous material is formed which is capable of undergoing carbonization and is non-burning when subjected to an ordinary match flame.

9. An improved process according to claim 8 wherein said multifilamentary acrylic fibrous material is selected from the group consisting of an acrylonitrile homopolymer and acrylonitrile copolymers containing at least 85 mole percent acrylonitrile units and up to about 15 mole percent of one or more monovinyl units copolymerized therewith.

10. An improved process according to claim 8 wherein said multifilamentary acrylic fibrous material is in the configuration of a tow.

11. An improved process according to claim 8 wherein said multifilamentary acrylic fibrous material is in the configuration of a yarn.

12. An improved process according to claim 8 wherein said oxidizing agent employed in step (c) is ammonium permanganate.

13. An improved process according to claim 12 wherein said ammonium permanganate is formed by the reaction of potassium permanganate and ammonium fluorosilicate.

14. An improved process according to claim 12 wherein said washing of step (d) is carried out at least in part in an ultrasonic bath.

15. An improved process according to claim 12 wherein said oxygen-containing atmosphere of step (e) is provided at a temperature of approximately 240° to 310° C.

16. An improved process for the relatively rapid thermal stabilization of a multifilamentary acrylic fibrous material in the substantial absence of filament coalescence comprising:

(a) contacting said acrylic fibrous material with an approximately 5 percent by weight aqueous solution of hydroxylamine having a pH of approximately 7 provided at a temperature of approximately 95° to 100° C. for approximaterly 2 to 6 minutes, (b) washing said fibrous material, (c) contacting said resulting fibrous material with an approximately 1.5 percent by weight aqueous solution of ammonium permanganate at a temperature of approximately 95° to 100° C. for approximately 1 to 4 minutes, (d) washing said fibrous material, and (e) heating said resulting fibrous material in a gaseous oxygen-containing atmosphere at a temperature of approximately 240° to 310° C. until a thermally stabilized acrylic fibrous material is formed which is capable of undergoing carbonization and is non-burning when subjected to an ordinary match flame.

17. An improved process according to claim 16 wherein said multifilamentary acrylic fibrous material is selected from the group consisting of an acrylonitrile homopolymer and acrylonitrile copolymers containing at least 85 mole percent acrylonitrile units and up to about 15 mole percent of one or more monovinyl units copolymerized therewith.

18. An improved process according to claim 16 wherein said multifilamentary acrylic fibrous material is in the configuration of a tow.

19. An improved process according to claim 16 wherein said multifilamentary acrylic fibrous material is in the configuration of a yarn.

20. An improved process according to claim 16 wherein said oxidizing agent employed in step (c) is ammonium permanganate.

21. An improved process according to claim 16 wherein said ammonium permanganate is formed by the reaction of potassium permanganate and ammonium fluorosilicate.

22. An improved process according to claim 16 wherein said washing of step (d) is carried out at least in part in an ultrasonic bath.

* * * * *